US008534367B2

(12) United States Patent
Carisella

(10) Patent No.: US 8,534,367 B2
(45) Date of Patent: Sep. 17, 2013

(54) WIRELINE PRESSURE SETTING TOOL AND METHOD OF USE

(76) Inventor: James V. Carisella, Baton Rouge, LA (US)

( * ) Notice: Subject to any disclaimer, the term of this patent is extended or adjusted under 35 U.S.C. 154(b) by 500 days.

(21) Appl. No.: 12/766,111

(22) Filed: Apr. 23, 2010

(65) Prior Publication Data

US 2011/0259607 A1 Oct. 27, 2011

(51) Int. Cl.
*E21B 23/00* (2006.01)
*E21B 29/02* (2006.01)
*E21B 43/00* (2006.01)

(52) U.S. Cl.
USPC ..... 166/381; 166/63; 166/102

(58) Field of Classification Search
USPC ..... 166/63, 381, 102; 29/401.1
See application file for complete search history.

(56) References Cited

U.S. PATENT DOCUMENTS

| | | | | |
|---|---|---|---|---|
| 3,125,162 | A | 3/1964 | Briggs et al. | |
| 3,160,209 | A | 12/1964 | Bonner | |
| 3,186,485 | A | 6/1965 | Owen | |
| 3,294,171 | A | 12/1966 | Kelley | |
| 3,378,078 | A * | 4/1968 | Current | 166/124 |
| 4,253,521 | A | 3/1981 | Savage | |
| 4,493,374 | A | 1/1985 | Magee | |
| 5,070,788 | A | 12/1991 | Carisella et al. | |
| 5,240,077 | A * | 8/1993 | Whitsitt | 166/383 |
| 5,320,182 | A | 6/1994 | Mendez | |
| 5,392,860 | A | 2/1995 | Ross | |
| 6,145,598 | A | 11/2000 | Carisella | |
| 6,164,375 | A | 12/2000 | Carisella | |
| 6,341,654 | B1 * | 1/2002 | Wilson et al. | 166/387 |
| 6,354,372 | B1 | 3/2002 | Carisella et al. | |
| 7,000,705 | B2 | 2/2006 | Buyers et al. | |
| 2009/0095466 | A1 * | 4/2009 | Obrejanu | 166/98 |

OTHER PUBLICATIONS

Is.myhalliburton.com; Completion Tools, DPU Downhole Power Unit (Data Sheet) Nov. 21, 2005.

Imre I. Gazda and John J. Golfton, Halliburton Energy Services; A Battery-Operated, Electro-Mechanical Setting Tool for Use with Bridge Plugs and Similar Wellbore Tools; OTC 7877-1995; pp. 71-82.

Petrowell Ltd.; Intervention Products—Non Explosive Setting Tool; 2008.

Petrowell Ltd.; Intervention Products—Motorised Setting Tool (MST); 2008.

* cited by examiner

*Primary Examiner* — Kenneth L Thompson
*Assistant Examiner* — Michael Wills, III
(74) *Attorney, Agent, or Firm* — Morgan, Lewis & Bockius LLP

(57) ABSTRACT

A method and apparatus for retro-fitting an explosive setting tool to a non-explosive setting tool is provided to eliminate the use of pyrotechnics when setting auxiliary tools. An explosive setting tool is retro-fitted by removing the pyrotechnic elements of the tool and replacing them with a conversion assembly including a hydraulic pump, thus converting the explosive tool into a non-explosive tool. The hydraulic pump provides the energy necessary to set the auxiliary tool. Once the auxiliary tool has been set, the non-explosive setting tool can be brought to the surface and reset using a resetting tool.

14 Claims, 10 Drawing Sheets

WIRELINE PRESSURE SETTING TOOL AND METHOD OF USE

TECHNICAL FIELD

This invention relates to a setting tool for use in a wellbore, and a method of using a setting tool.

BACKGROUND OF THE INVENTION

Subterranean well tools are introduced or carried into a subterranean oil or gas well on a conduit, such as wire line, electric line, continuous coiled tubing, threaded work string, or the like, for engagement at a pre-selected position within the well along another conduit having an inner smooth wall, such as casing. These tools include devices such as expandable elastomeric, permanent or retrievable plugs, packers, ball-type and other valves, injectors, perforating guns, tubing and casing hangers, cement plug dropping heads, and other devices typically encountered during the drilling, completion, or remediation of a subterranean well. Such devices and tools will hereafter collectively be referred to as "auxiliary tools." The auxiliary tool is typically set and anchored into position within the casing such that movements in various directions such as upwardly, downwardly, or rotationally, are resisted, and, in fact, prevented. Such movements may occur as a result of a number of causes, such as pressure differentials across the tool, temperature variances, tubing or other conduit manipulation subsequent to setting for activation of other tools in the well, and the like.

When positioned at the required depth, the auxiliary tool must be set. This typically requires shearing locating pins, setting a "slip" mechanism that engages and locks the auxiliary tool with the casing, and energizing the packing element in the case of setting a plug. This requires large forces, often in excess of 20,000 lbs. The activation or manipulation of some of such auxiliary tools often is achieved by use of some sort of apparatus, commonly referred to as a "setting tool," which may be introduced into the well along with or subsequent to the auxiliary tool on wire or electric line, continuous or coiled tubing, or by other known means. Many types of setting tools exist. Some of these setting tools are known to apply hydrostatic well pressure within well fluids at the setting or activating depth through the setting apparatus and upon a face of a piston head or the like to move a stroking rod, cylinder or housing member in a direction to activate manipulation of the setting tool. Likewise, some of these setting tools are hydraulically operated, either by use of a pump in the setting tool that develops hydraulic pressure or surface pumps that transmit hydraulic pressure through tubing to the setting tool.

However, the most commonly used setting tools are those that are activated by means of an explosive called a pyrotechnic or "black power" charge to cause an explosion within a portion of the housing of the manipulation tool and the energy defined by this explosion drives such piston, stroking rod, or other member to cause the manipulation of the auxiliary tool. By "explosion" it is meant the continuous generation, sometimes relatively slowly, of energy by electric activation of a power charge-initiated reaction which results in a build up within a chamber of transmittable gaseous pressure within the apparatus. The industry standard explosive setting tool is the Model E-4 Wireline Pressure Setting Assembly, Product No. 437-02, of Baker International Corporation; however others, such as the Halliburton "Shorty" also exist.

After the auxiliary tool is set, the explosive setting tool remains pressurized and must be raised to the surface and depressurized. This typically entails bleeding pressure off the setting tool by rupturing a piercing disk with a piercing screw, thus creating a vent hole that allows the gas within the setting tool to bleed off. Not only is the depressurization of the setting tool dangerous, but it also exposes personal to potentially hazardous chemicals that result from the combustion of the pyrotechnic. Thus, this operation must be carried out under strictly controlled conditions.

While many procedures have been developed to minimize the risks associated with an explosive setting tool, many disadvantages inherent in the use of an explosive setting tool still remain. Explosives are dangerous to handle and difficult to store and maintain on the job site. This requires the use of trained explosives personnel at every stage of operation. Special permits and licenses are often required to comply with State and local safety regulations. Additionally, the use of explosives requires the controlled, gradual lowering of the setting tool. Certain of the prior setting tools have included an orifice in the body of the tool through which oil is forced as detonation occurs to thereby slow the setting action on the device being set. Also, explosives which are "slow burning" are employed in order to lessen the undesirable effects of a sudden explosion. Moreover, the use of explosives requires that the firing chamber of the tool be cleaned after every use, thereby adding to the maintenance requirements of the tool.

Obviously, as can be seen from the above, the use of explosives should be avoided if at all possible. While there are other alternatives available, a large number of explosive setting tools are in use. Therefore there exists a need for a means to convert an explosive setting tool, such as those described above, to non-explosive setting tools.

BRIEF SUMMARY OF THE INVENTION

In one aspect, the present invention provides a non-explosive setting tool for use in setting an auxiliary tool. In particular, the invention includes a conversion assembly that retrofits an explosive setting tool that includes explosive elements, a pressure chamber, an upper cylinder, a lower cylinder, and a cylinder connector, by removal of the pressure cylinder, the upper cylinder, and the cylinder connector and installing a conversion assembly that includes a motor controller, a gear motor, and a hydraulic pump.

In another aspect, the present invention provides a non-explosive setting tool for use in setting an auxiliary tool. In particular, the invention includes conversion elements that retrofit an explosive setting tool that includes explosive elements, a pressure chamber, an upper cylinder, a lower cylinder, and a cylinder connector that has been configured to receive conversion elements by removing of the floating piston and installing an insulated contact terminal and conversion elements. The conversion elements including a motor controller, a gear motor, a hydraulic pump including a pump inlet and pump outlet, and a face seal engaging mechanism.

In another aspect, the present invention includes a method of retrofitting an explosive setting tool that includes a pressure chamber, an upper cylinder, a lower cylinder, and a cylinder connector, for use in setting an auxiliary tool. The method includes the steps of removing the pressure chamber; removing the upper cylinder; removing the cylinder connector; and installing a conversion assembly.

In another aspect, the present invention includes a method of retrofitting an explosive setting tool, the tool including a pressure chamber, an upper cylinder, a lower cylinder, and a cylinder connector, for use in setting an auxiliary tool. The method includes the steps of: removing the floating piston from the explosive setting tool; installing conversion elements into the upper cylinder of the explosive setting tool; installing an insulated contact terminal in the pressure chamber of the explosive setting tool; and connecting the conversion elements with the insulated contact terminal.

In another aspect, the present invention includes a method of resetting a non-explosive setting tool including a pressure chamber, and upper cylinder, and a face seal engaging mechanism. The method including the steps of: disengaging the face seal engaging mechanism by unscrewing the pressure chamber from the upper cylinder thereby creating a fluid return path through the face seal engaging mechanism; placing the non-explosive setting tool in a resetting tool configured to support the non-explosive setting tool, the resetting tool being dimensioned to receive the cross link sleeve of the non-explosive setting tool; engaging the face seal engaging mechanism by screwing the pressure chamber into the upper cylinder thereby engaging the face seal engagement mechanism.

DETAILED DESCRIPTION OF THE INVENTION

As used herein, "a" or "an" means one or more than one. Additional, distal refers to the end of the element closest to the setting mandrel of the setting tool and proximal end refers to the end of the element closest to the firing head of the setting tool.

The methods and apparatus of the present invention will now be illustrated with reference to FIGS. 1A through 9. It should be understood that these are merely illustrative and not exhaustive examples of the scope of the present invention and that variations which are understood by those having ordinary skill in the art are within the scope of the present invention.

Figure 1A:
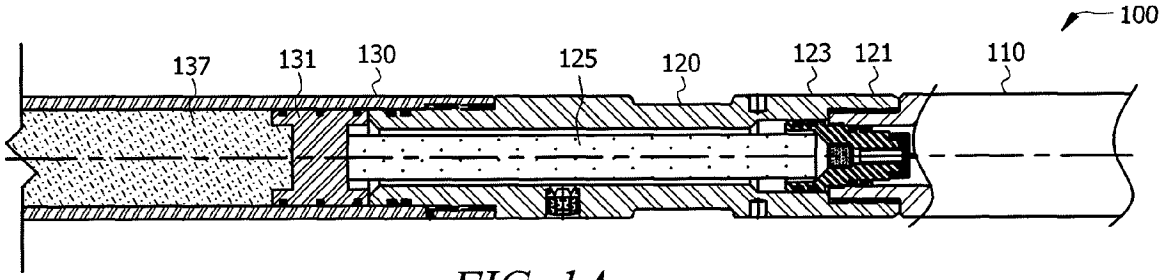
FIG. 1A PRIOR ART
FIGS. 1A and 1B schematically depict an explosive setting tool with explosive components in place.
Figure 1B:
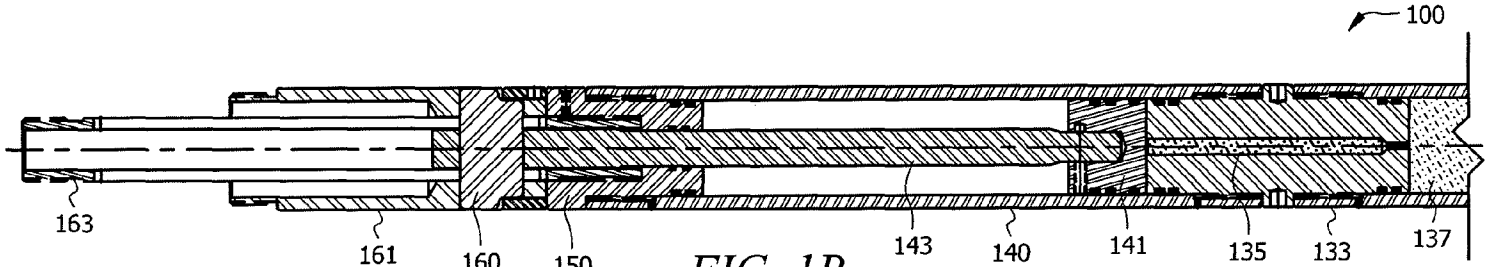
FIG. 1B PRIOR ART

Turning now to FIGS. 1A and 1B, a prior art explosive setting tool 100 is shown. The explosive setting tool includes firing head 110, pressure chamber 120, upper cylinder 130, lower cylinder 140, cylinder head 150, and crosslink 160. Explosives or pyrotechnics are typically installed in pressure chamber 120. Typical prior art explosive setting tools include three explosive elements, primary igniter 121, secondary igniter 123, and power charge 125. The distal end of pressure chamber 120 is connected to upper cylinder 130 by a threaded connection and includes rubber O-rings to seal the connection between pressure chamber 120 and upper cylinder 130. Additionally, the distal end of pressure chamber 120 includes an orifice that allows fluid communication between pressure chamber 120 and upper cylinder 130.

Upper cylinder 130 includes floating piston 131. The distal end of the upper cylinder is connected to the proximal end of cylinder connector 133. The intersection of the upper cylinder 130, floating piston 131 and cylinder connector 133, forms a hydraulic fluid reservoir 137, which contains hydraulic fluid used to transfer power from the gas generated by the combustion of primary initiator 121, secondary igniter 123, and power charge 125 to piston 141. Cylinder connector 133 contains passageway 135 that allows hydraulic fluid to pass through cylinder connector and apply hydraulic pressure on piston 141.

The proximal end of lower cylinder 140 is connected to the distal end of cylinder connector 133. Piston 141 is attached to the proximal end of piston rod 143. The distal end of the piston rod passes through an orifice in cylinder head 150. Additionally, the distal end of lower cylinder 140 is attached to the proximal end of cylinder head 150 by a threaded connection. Additionally, cylinder head 150 includes internal and external O-rings that provide a seal between cylinder head 150 and lower cylinder 140 and between the cylinder head and piston rod 143. Attached to the distal end of piston rod 143 is crosslink 160. The crosslink includes crosslink sleeve 161 and setting mandrel 163.

Figure 2:
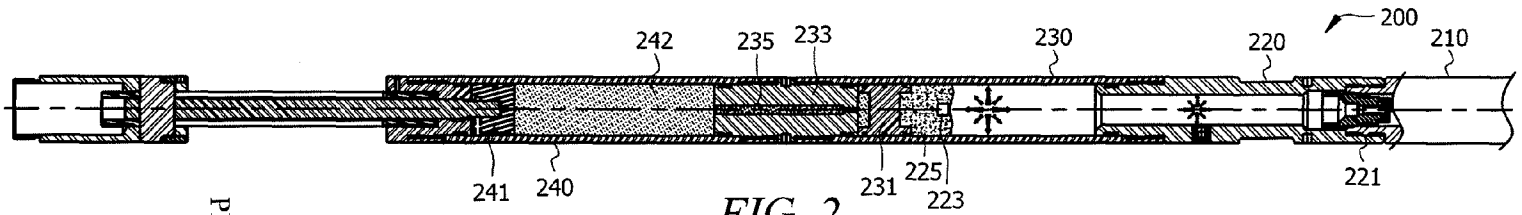
FIG. 2 PRIOR ART
FIG. 2 schematically depicts an explosive setting tool after the explosive components have been consumed.

FIG. 2 shows a conventional explosive setting tool 200 after the explosive or pyrotechnic elements have been consumed. When the explosive setting tool is used, the primary igniter, secondary igniter, and the power charge are consumed and generate a large amount of gas as a result of a combustion reaction. Setting tool 200 now contains a fired primary igniter 221, spent secondary 223, and ash 225 resulting from the combustion of the pyrotechnics. The gas generated as a result of the combustion of the pyrotechnics forces floating piston 231 down to the cylinder connector 233, which in turn forces hydraulic fluid through passageway 235 in the cylinder connector 233. This results in approximately 3,000 to 6,000 psig of pressure forming in the space created by pressure chamber 220 and the portion of upper cylinder 230 above the floating piston 231.

The hydraulic fluid entering lower cylinder 240 applies hydraulic pressure to piston 241, which forces the piston to move from the proximal end of lower cylinder 240 to the distal end of lower cylinder 240. This creates a hydraulic reservoir 242 in lower cylinder 240 in be space between the distal end of cylinder connector 233 and piston 241. Once the setting tool is fired, it must now be raised to the surface and reset. This will require reliving the residual pressure in pressure chamber 220 and upper cylinder 230, cleaning upper cylinder 230 to remove spent secondary igniter 223 and ash 225 remaining from the combustion of the pyrotechnics, and returning the piston and hydraulic fluid to their original position. Once the tool has been cleaned, it must be inspected, and the primary igniter, secondary igniter, and power charge replaced. In addition to the various health and safety issues associated with the use of the pyrotechnics, the inspection and resetting of the tool requires significant time and expense. Because of the large number of existing explosive setting tools, a means of retrofitting explosive setting tools to eliminate these issues is desired.

Figure 3A:
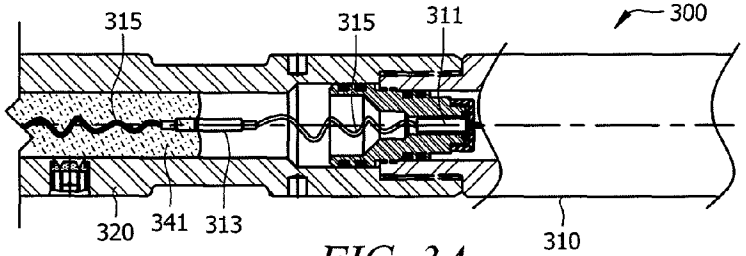
FIGS. 3A, 3B, and 3C schematically depict a retrofitted setting tool with the conversion elements necessary to retrofit the explosive setting tool to a non-explosive setting tool.
Figure 3B:
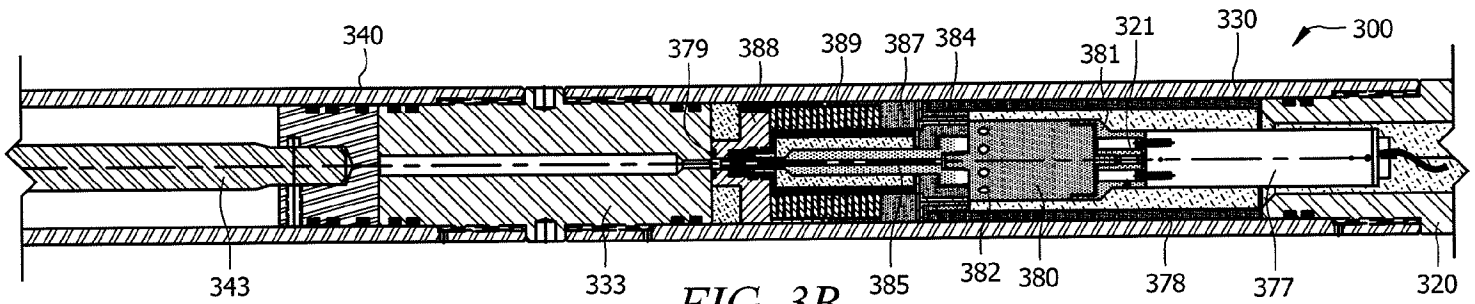
Figure 3C:
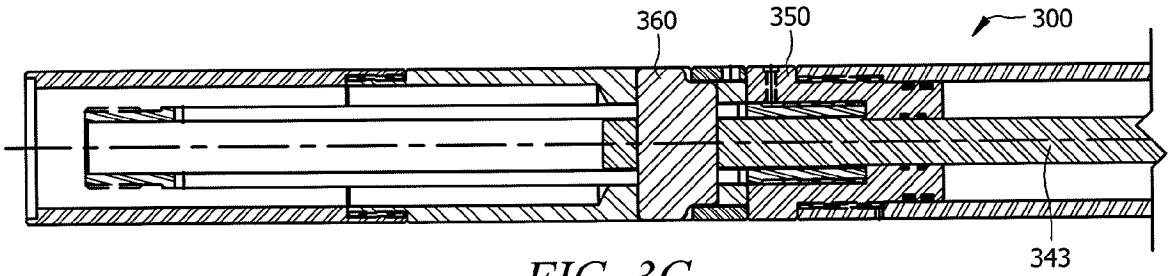

To convert the explosive setting tool to a non-explosive setting tool, the primary igniter, secondary igniter, power charge, and floating piston are removed from the setting tool and are replaced with conversion elements shown in FIGS. 3A-3C. The conversion elements include an insulated contact terminal 311, male, female electrical connection 313, motor controller and gear motor 377, hydraulic pump 380, and upper and lower spring housings 387 and 388, respectively. The insulated contact terminal 311 is connected to one part of the male, female connection 313 using multi-strand wire 315; the other part of the male, female connection 313 is connected to the motor controller and gear motor 377. Motor controller and gear motor 377 connected to the hydraulic pump 380 via motor pump attachment piece 381 and motor shaft 321 is connected to pump 380 via a coupling. Pump 380 and a portion of the motor controller and gear motor 377 are housed within the sliding tube 378, which is machined to fit within the upper cylinder of the setting device. Pump 380 includes an inlet 382 that allows low pressure hydraulic fluid to enter the pump and outlet 384 that allows high pressure hydraulic fluid to exit pump 380. Pump outlet 384 is in contact with the discharge rod 385. The conversion elements also include a spring housing that includes upper spring housing 387, lower spring housing 388, and springs 389. The distal end of the spring housing includes an O-ring face seal 379.

Pump 380 is preferably a positive displacement pump, such as, rotary lobe, progressive cavity, screw, gear, hydraulic, or the like can be utilized. Further springs 389 are preferably disk springs, however any compression spring can be utilized.

Retrofitted setting tool 300 shows the tool configured ready to run in the well and includes firing head 310, pressure chamber 320, upper cylinder 330, lower cylinder 340, cylinder head 350, crosslink 360, and the conversion elements. With the pyrotechnics removed from pressure chamber 320, insulated contact terminal 311 is installed in pressure chamber 310 in place of the primary igniter. The distal end of pressure chamber 320 is connected to upper cylinder 330 by a threaded connection and includes rubber O-rings to seal the connection between pressure chamber 320 and upper cylinder 330. Additionally, the distal end of pressure chamber 320 includes an orifice that allows fluid communication between pressure chamber 320 and upper cylinder 330.

With the floating piston removed, the conversion elements including the controller and gear motor 377, hydraulic pump 380, sliding tube 378, and a spring housing are installed in the upper cylinder 330. As with the explosive setting tool, the distal end of upper cylinder 330 is connected to the proximal end of cylinder connector 333. The remaining portion of the setting tool is unchanged from the description above. Sliding tube 378 is dimensioned to fit inside upper cylinder 330 and further dimensioned to be engaged by pressure cylinder 330. As the threaded connection between pressure chamber 320 and upper cylinder 330 is tightened, the face seal 379 of the conversion elements is energized. As the threaded connection is tightened, disk springs 389, which are housed between upper spring housing 387 and lower spring housing 388 are compressed, thus energizing the face seal, which is between the lower spring housing 388 and the proximal end of the cylinder connector 333. Further, piston rod 343 is fully seated in lower spring housing 388, sealing discharge rod 385 with lower spring housing 388. With the face seal energized, the hydraulic fluid, which is stored in the void space of pressure chamber 320 and the upper cylinder 330, is sealed from the passage through cylinder connector 333 and lower cylinder 340. With face seal 379 of the conversion assemble energized, the pathway of the hydraulic fluid in the pressure chamber 320 and the upper cylinder 330 is through hydraulic pump 380 via pump outlet 384 and discharge rod 385.

Figure 4:
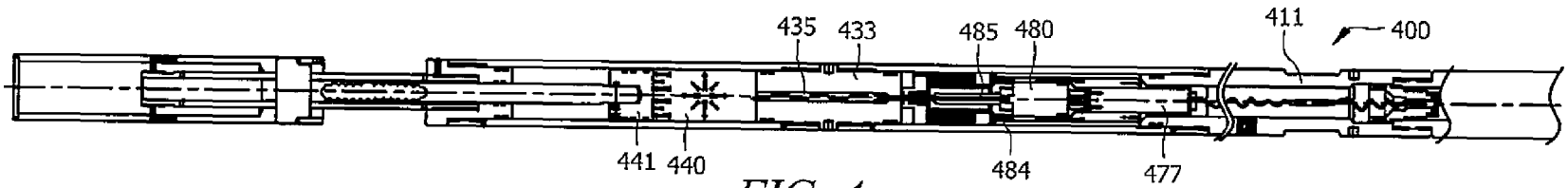
FIG. 4 schematically depicts a retrofitted setting tool after the piston has been stroked.

FIG. 4 shows retrofitted setting tool 400 after the tool has moved through the setting stroke motion. After a control signal is sent to the insulated contact terminal 411, control logic in the controller and gear motor 477 is activated. The controller can be programmed to energize the motor and run the pump while contact terminal 411 is activated, for a set period of time, until all hydraulic fluid is pumped, for a specific stroke length, or until a specific pump outlet pressure is obtained. Further, the pump control logic can be programmed to vary the stroke speed, the stroke pressure, and other timing elements. Once the energized, hydraulic pump 480 transports hydraulic fluid through pump outlet 484 and discharge rod 485 through passage 435 way in the cylinder connector 433. This exerts pressure on the face of piston 441 and forces piston 441 to travel down toward the distal end of lower cylinder 440. The hydraulic fluid accumulates in a reservoir created in lower cylinder 440 between piston 441 and the lower face of cylinder connector 433.

Figure 5A:
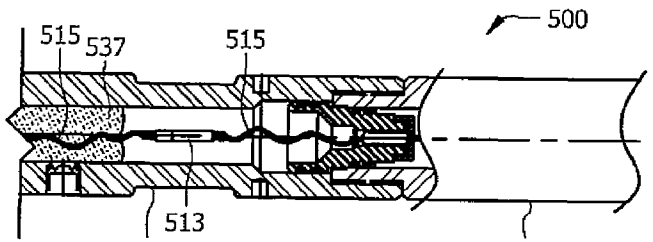
FIGS. 5A, 5B, and 5C schematically depict a retrofitted setting tool and resetting tool.
Figure 5B:
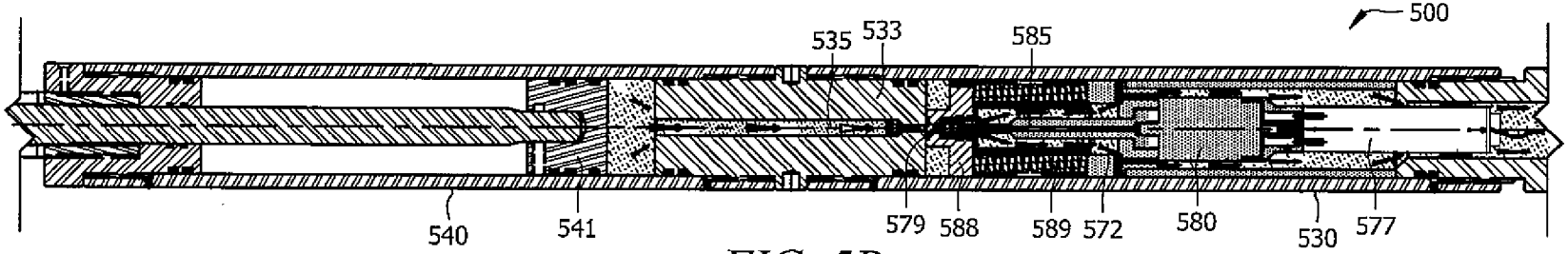
Figure 5C:
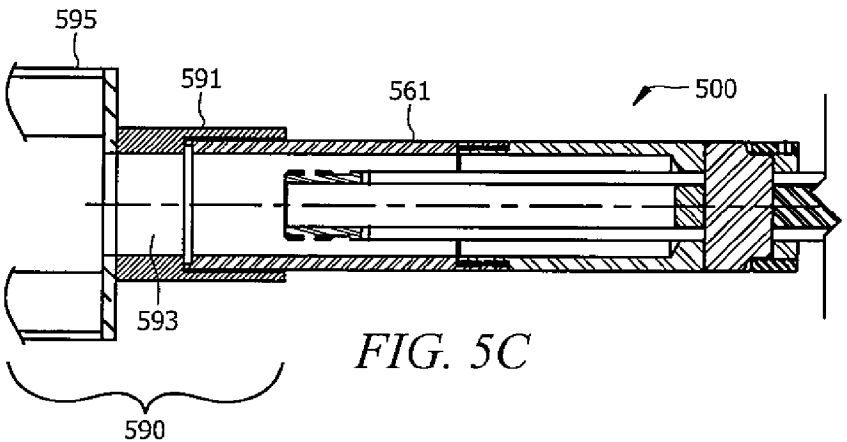

Once the setting tool has moved through its setting motion and the auxiliary tool has been set, the tool must be raised to the surface to be reset. FIG. 5A-5C shows retrofitted setting tool 500 and resetting tool 590. Once raised to the surface, pressure chamber 520 is partially unscrewed from the upper cylinder 530 to disengage the face seal by releasing disk springs 589 in a spring housing. Once the face seal 579 is disengaged, the discharge rod 585 is unseated from the lower spring housing 588 creating a fluid path allowing hydraulic fluid to flow from the lower cylinder 540 through passage way 535 in cylinder connector 533, through a passage way in lower spring housing 588 and through the fluid return path 572, around hydraulic pump 580, and controller and motor 577 into hydraulic reservoir 537.

Retrofitted setting tool 500 is then set on resetting tool 590 which is designed to receive cross link sleeve 561. The weight of setting tool 500 is used to force piston 541 back to its original position by the distal end of cylinder connector 533. This forces the hydraulic fluid through the through the fluid path allowing hydraulic fluid to flow from the lower cylinder 540 through the passage way 535 in cylinder connector 533, through a passage way in lower spring housing 588 and through fluid return path 572, around hydraulic pump 580, and controller and motor 577 into the hydraulic reservoir 537. Once reset, pressure chamber 520 is screwed into the upper cylinder 530. Once tightened, face seal 579 is energized and discharge rod 585 is reseated in lower spring housing 588 and the tool is reset for use.

FIG. 5C shows a detailed view of resetting tool 590. Resetting tool 590 includes upper cylinder 591 and lower support member 595. The opening of upper cylinder 591 is designed to receive and support the cross link sleeve of the setting tool. Lower support member 595 is designed to provide sufficient clearance of the setting mandrel, which passes through accommodation hole 593 in the resetting tool when the tool is reset.

Figure 6A:
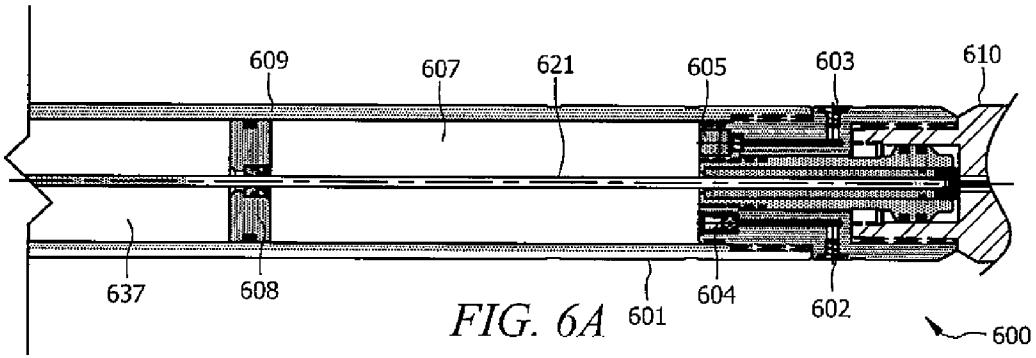
FIGS. 6A, 6B, 6C, and 6D schematically depict a retrofitted setting tool with the conversion elements and attic cylinder in place.
Figure 6B:
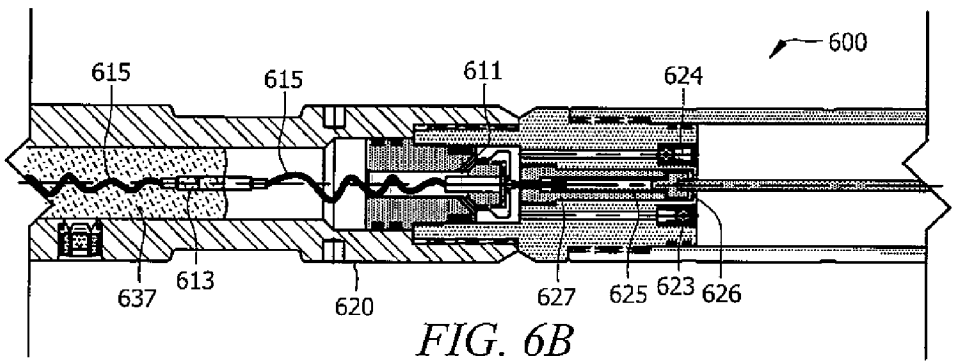
Figure 6C:
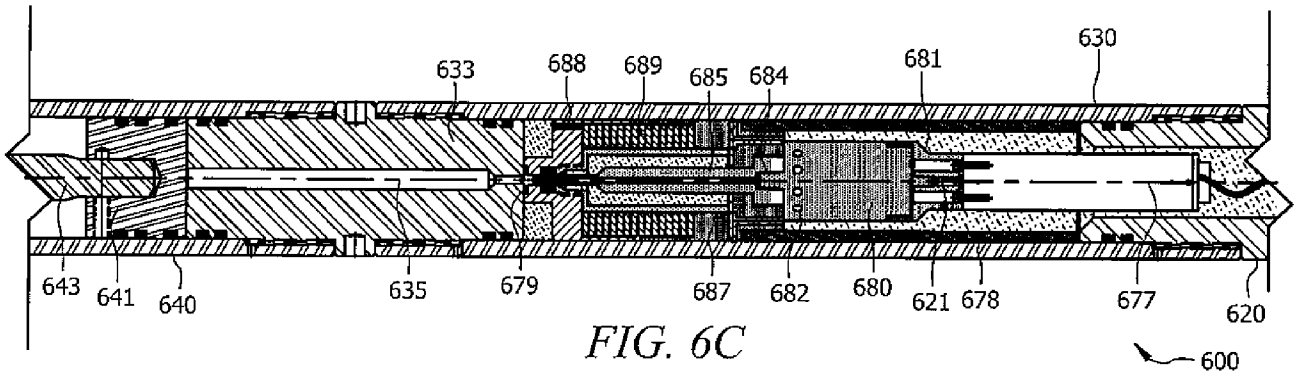
Figure 6D:
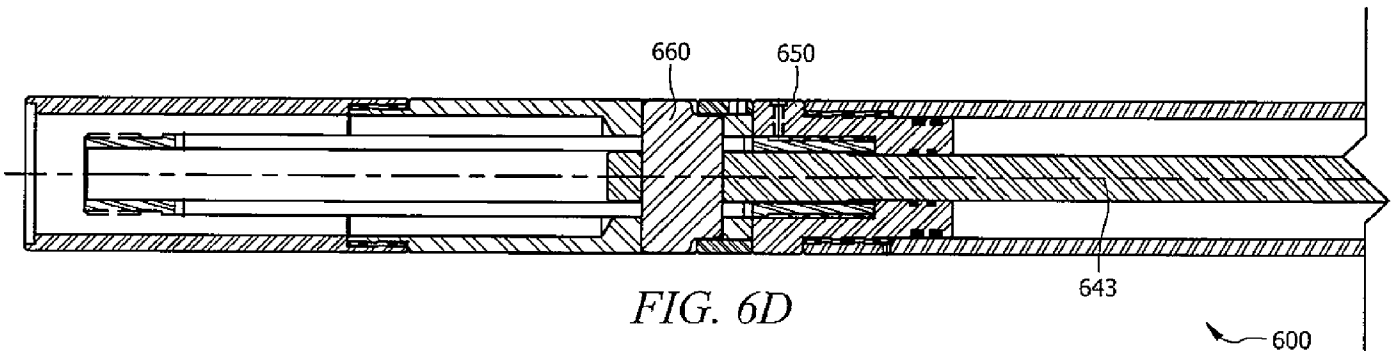

An alternative preferred embodiment of the present invention is illustrated in FIGS. 6A-6A. In this embodiment, an additional cylinder is added to the retrofitted setting tool to allow for use of the tool in horizontal applications. In horizontal applications, it is likely that air pockets can develop in the hydraulic reservoir, which may result in pump becoming air locked. To prevent this situation, an additional cylinder is added to the setting tool. This cylinder provides a pressurized attic to minimize the potential of air pocket formation in the hydraulic reservoir that may lead air locking of the pump. Similarly to the embodiment described above, the firing head, primary igniter, secondary igniter, power charge, and floating piston are removed from the setting tool and are replaced with conversion elements shown in FIGS. 6A-6D. The conversion elements include insulated contact terminal 611, male, female electrical connection 613, motor controller and gear motor 677, hydraulic pump 680, and a spring housing. Insulated contact terminal 611 is connected to one part of male, female connection 613 using multi-strand wire 615. The other part of male, female connection 613 is connected to motor controller and gear motor 677. Motor controller and gear motor 677 is connected to hydraulic pump 680 via motor pump attachment piece 681. Motor shaft 621 is connected to the pump 680 via a coupling. Pump 680 and a portion of the motor controller and gear motor 677 are housed within the sliding tube 678, which is machined to fit within the upper cylinder of the setting device. Pump 680 includes inlet 682 that allows low pressure hydraulic fluid to enter pump 680 and outlet 684 that allows high pressure hydraulic fluid to exit pump 680. Pump outlet 684 is in contact with discharge rod 685. The conversion elements also include a spring housing that includes upper spring housing 687, lower spring housing 688, and springs 689. The distal end of the spring housing includes an O-ring face seal 679.

Retrofitted setting tool 600 shows the tool configured ready to run in the well and includes firing head 610, attic cylinder 601, pressure chamber 620, upper cylinder 630, lower cylinder 640, cylinder head 650, crosslink 660, and the conversion elements installed. With the pyrotechnics removed from pressure chamber 620, insulated contact terminal 611 is installed in the pressure chamber 610 in place of the primary igniter. The distal end of pressure chamber 620 is connected to upper cylinder 630 by a threaded connection and includes rubber O-rings to seal the connection between pressure chamber 620 and upper cylinder 630. Additionally, the distal end of pressure chamber 620 includes an orifice that allows fluid communication between pressure chamber 620 and the upper cylinder 630.

With the floating piston removed, controller and gear motor 677, hydraulic pump 680, sliding tube 678, and a spring housing are installed in upper cylinder 630. As with the explosive setting tool, the distal end of upper cylinder 630 is connected to the proximal end of cylinder connector 633. The remaining portion of the setting tool is unchanged from the description above. Sliding tube 678 is dimensioned to fit inside the upper cylinder 630 and further dimensioned to be engaged by the pressure cylinder 630. As the threaded connection between the pressure chamber 620 and the upper cylinder 630 is tightened, the face seal 679 of the conversion elements is energized. As the threaded connection is tightened, the disk springs 689, which are housed between upper spring housing 687 and lower spring housing 688 are compressed, thus energizing the face seal, which is between lower spring housing 688 and the proximal end of cylinder connector 633. Further, piston rod 643 is fully seated in the lower spring housing, sealing discharge rod 685 with the lower spring housing 688. With the face seal energized, the hydraulic fluid, which is stored in the void space of pressure chamber 620 and upper cylinder 630, is sealed from the passage through the cylinder connector 633 and lower cylinder 640. With face seal 679 of the conversion assemble energized, the pathway of the hydraulic fluid in pressure chamber 620 and upper cylinder 630 is through hydraulic pump via the pump outlet and discharge rod 685.

The distal end of attic cylinder 601 is connected to proximal end of pressure cylinder 610 by a threaded connection. However, other connection means, such as weld connections, are also contemplated by the invention. Attic cylinder 601 includes floating piston 608, which divides the attic cylinder into upper attic air space 607 and lower hydraulic reservoir 637. Attic cylinder 601 also includes inlet 602 and exhaust outlet 603 that allows for pressurization of attic air space 607, both of which include a plug for sealing the opening. Inlet 602 also includes check valve 604, which allows for fluid to enter air attic space 607. Any check valve or one-way valve, such as a ball check, diaphragm, or swing check valve, can be used. In this embodiment, a check valve with a 5 to 15 psig cracking pressure is contemplated. Exhaust outlet 603 also includes pressure relief valve 605 to prevent over pressurization of attic air space 607. Again, any valve or one-way valve, such as a ball check, diaphragm, or swing check valve, can be used. In this application, a check valve with a 75 psig cracking pressure is contemplated to maintain attic air space at 75 psig.

The attic air space is pressurized by removing the plugs from inlet 602 and exhaust outlet 603 and introducing a fluid, preferably a compressible gas such as air or nitrogen, into attic air space 607. Once the pressure in attic air space 607 reaches 75 psig, pressure relief valve 605 opens, signaling that the attic air pressure has reached the desired pressure. The fluid source is then removed and inlet 602 and exhaust outlet 603 are plugged.

The attic air pressure provides the force to floating piston 608 that causes piston 608 to move in response to changes in the hydraulic reservoir volume. For example, as hydraulic fluid is pumped from hydraulic reservoir 637, the volume of hydraulic reservoir 637 is reduced. The compressed fluid in air attic space 607 expands and forces floating piston 608 to move toward the distal end of attic cylinder 601, thus reducing the volume of hydraulic reservoir 637 and preventing air pockets from forming in the reservoir. Floating piston 608 is dimensioned to fit within the inner diameter of attic cylinder 601 and includes seals, such as rubber O-rings, at its interface with the cylinder to prevent hydraulic fluid from entering attic air space 607. Additionally, conductor rod 621 extends through attic cylinder 601 to allow control signals to be transmitted from through attic cylinder 601 and to insulated contact 611. This conductor rod can be made of any conductive material, including, for example, metallic conductors such as aluminum, cooper, gold, and silver and non-metallic conductors such as graphite. Floating piston 608 includes an opening allowing the piston to slide on conductor rod 621. Floating piston 608 includes a non-conductive material 609 that contacts conductor rod 621. Non-conductive material 609 allows piston 608 to contact conductor rod 621 without allowing the electric control signals to energize piston 608 and, thus, tool 600. Non-conductive material 609 may also include seals, such as O-rings, to provide seals between the non-conductive material 609 and conductor 621 and between non-conductive material 609 and piston 608. These seals prevent hydraulic fluid from leaking into attic air space 607.

The distal end of attic cylinder 601 includes two fluid passageways allowing for fluid communication with hydraulic reservoir 637 in pressure cylinder 620 and upper cylinder 630. One passageway is defined at one end by outlet check valve 623. Outlet check valve 623 allows for hydraulic fluid to pass from hydraulic reservoir 637 in attic cylinder 601 to hydraulic reservoir 637 in pressure chamber 620. The other passageway is defined by inlet check valve 624. Inlet check valve 624 allows hydraulic fluid to pass from hydraulic reservoir 637 pressure chamber 620 to hydraulic reservoir 637 in attic cylinder 601. As with the check vales described above, any valve or one-way valve, such as a ball check, diaphragm, or swing check valve, can be used. In this application, a check valve with a 75 psig cracking pressure is contemplated. Inlet check valve 623 and outlet check valve 624 allows for removal of attic cylinder 601 from the pressure cylinder 620 while preventing leakage of hydraulic fluid form the attic cylinder.

Attic cylinder 601 also includes upper contact 626, contact spring 625, and lower contact 627 that transmit the control signal from conductive rod 621 through upper contact 626, through contact spring 625, and through lower contact 627.

Contact spring 625 is compressed when attic cylinder 601 is connected with pressure cylinder 620 and provides the force to maintain lower contact 627 seated against contact terminal 611. Upper contact 626, lower contact 627, and contact spring 625 are preferably surrounded by an insulation material to prevent transmission of the electrical control signal to the tool. Additionally, the upper contact 626, lower contact 627, and contact spring 625 are sealed such that hydraulic fluid cannot leak either into or out of the attic cylinder.

Figure 7A:
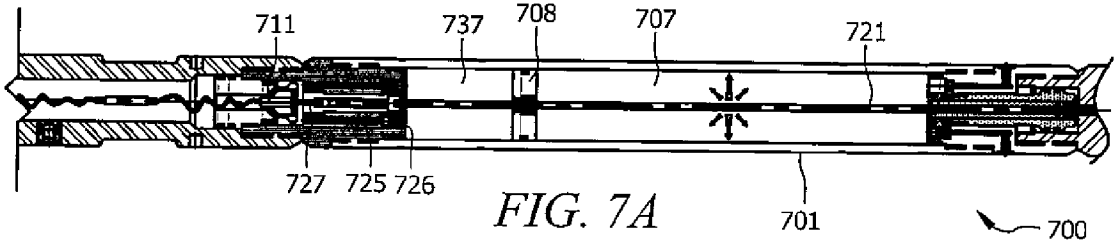
FIGS. 7A and 7B schematically depict a retrofitted setting tool with conversion elements and attic cylinder in place after the piston has been stroked.
Figure 7B:
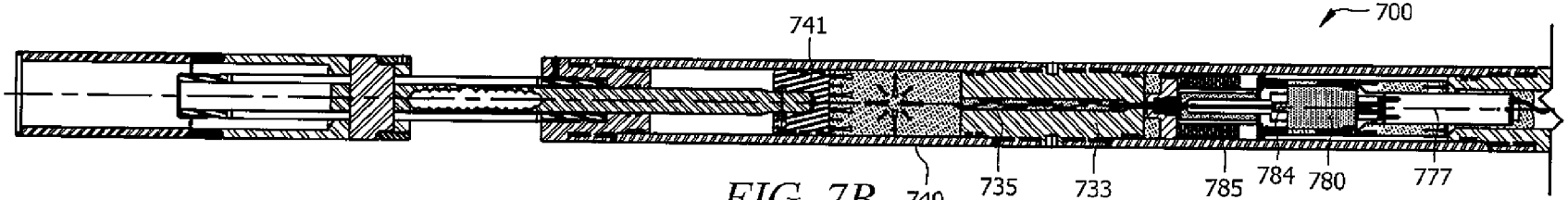

FIGS. 7A-7B show retrofitted setting tool 700 after the tool has moved through the setting stroke motion. After a control signal is sent through contact rod 721, upper contact 726, contact spring 725, and lower contact 727 to the insulated contact terminal 711, control logic in the controller and gear motor 777 is activated. The controller can be programmed to energize the motor and run the pump while contact terminal 711 is activated, for a set period of time, until all hydraulic fluid is pumped, for a specific stroke length, or until a specific pump outlet pressure is obtained. Further, the pump control logic and be programmed to vary the stroke speed, the stroke pressure, and other timing elements. Once the energized, hydraulic pump 780 transports hydraulic fluid through pump outlet 784 and discharge rod 785 through passage 735 way in the cylinder connector 733. This exerts pressure on the face of piston 741 and forces piston 741 to travel down toward the distal end of lower cylinder 740. The hydraulic fluid accumulates in a reservoir created in lower cylinder 740 between the piston 741 and the lower face of the cylinder connector 733. Additionally, the volume of hydraulic reservoir 737 in attic cylinder 701 is reduced and the fluid in attic air space 707 expands to force floating piston 708 toward the distal end of the attic cylinder, thus minimizing the volume of hydraulic reservoir 737 and minimizing the possibility for the formation of an air pocket that could cause the pump to air lock.

Figure 8A:
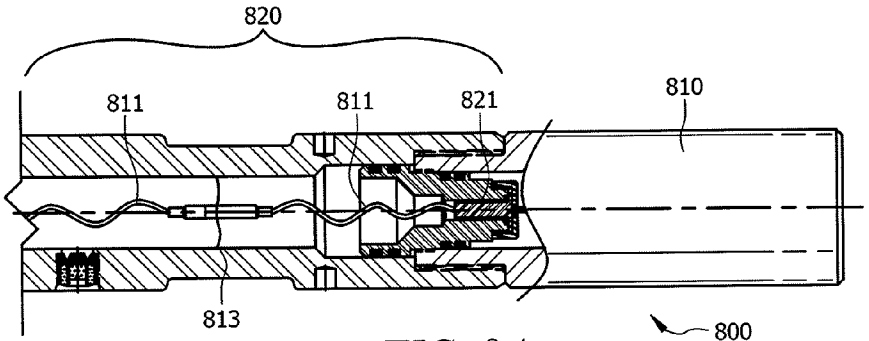
FIGS. 8A, 8B, and 8C schematically depict a retrofitted setting tool with the conversion assembly.
Figure 8B:
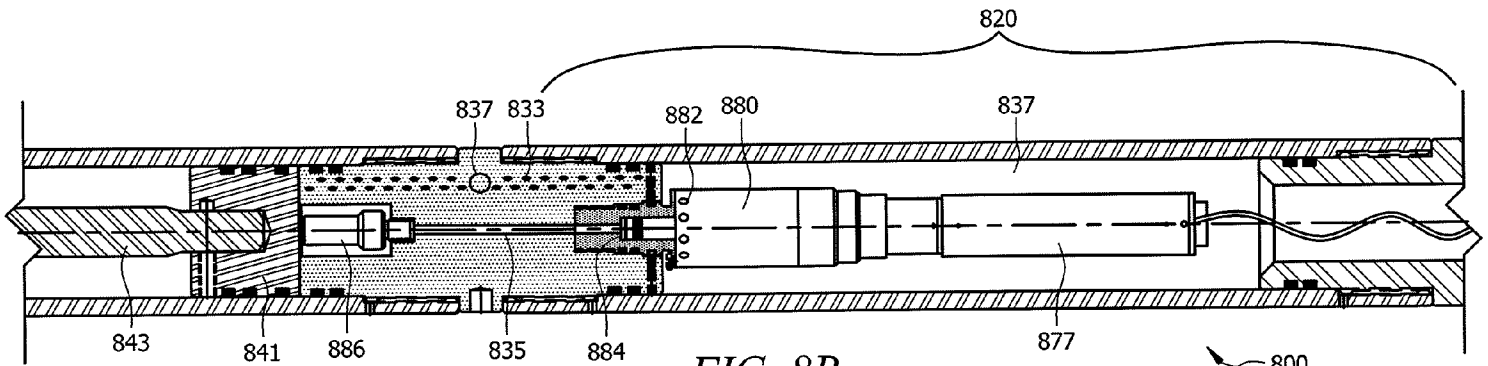
Figure 8C:
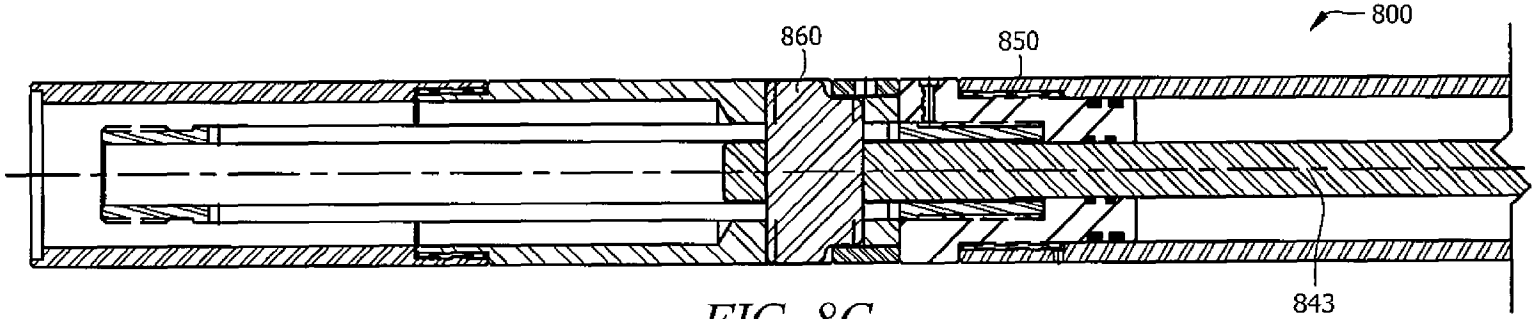

An alternative preferred embodiment is show in FIGS. 8A-8C. In this embodiment, firing head, pressure chamber, and upper cylinder of the prior art cylinder depicted in FIG. 1 are removed and replaced with a conversion assembly 820 as illustrated in FIGS. 8A and 8B. Conversion assembly 820 includes a cylinder with an upper or proximal end dimensioned to receive firing head 810. The conversion assembly also includes insulated contact terminal 811, male, female electrical connection 813, a motor controller and gear motor 877, hydraulic pump 880, and check valve 886. The insulated contact terminal 811 is connected to one part of male, female connection 813 using multi-strand wire 815. The other part of the male, female connection 813 is connected to motor controller and gear motor 877. Pump 880 includes an inlet 882 that allows low pressure hydraulic fluid to enter the pump and an outlet 884 that allows high pressure hydraulic fluid to exit the pump 880. The pump outlet is in fluid communication with check valve 886. As with the check vales described above, any valve or one-way valve, such as a ball check, diaphragm, or swing check valve, can be used. In this application, a check valve with a 250 psig cracking pressure is contemplated. A reset fluid path is also included. Conversion assembly 820 may also include reset tandem sub 833. Reset tandem sum 833 provides fluid pathway 835 from pump outlet 884 to check valve 886. This pathway allows pump 880 to pump hydraulic fluid and forces piston 841 toward the distal end of the tool and, in turn, forces piston rod 843 down through cylinder head 850, causing cross link 860 to stroke. Reset tandem sum 833 also provides a return fluid pathway 837 that allows hydraulic fluid to return to hydraulic reservoir 837. Preferably, the passageway includes a ball valve that can be opened to allow fluid to flow into hydraulic reservoir 837 to reset the tool for use.

Figure 9:
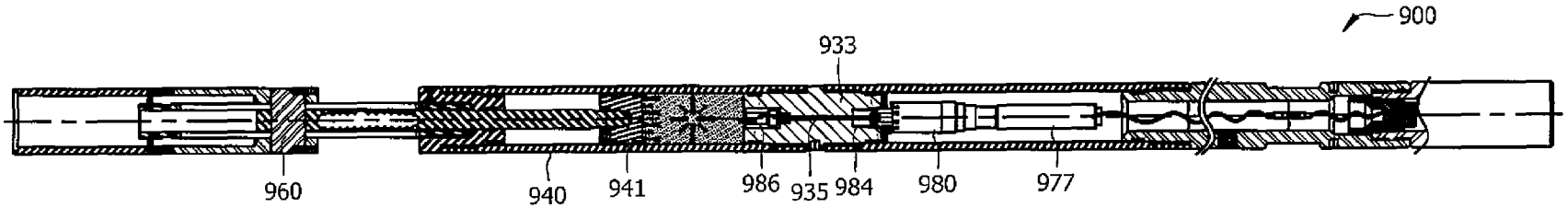
FIG. 9 schematically depicts a retrofitted setting tool with conversion assembly after the piston has been stroke.

FIG. 9 shows retrofitted setting tool 900 after the tool has moved through the setting stroke motion. After a control signal is sent to insulated contact terminal 911, control logic in controller and gear motor 977 is activated. The controller can be programmed to energize the motor and run the pump while the contact terminal 911 is activated, for a set period of time, until all hydraulic fluid is pumped, for a specific stroke length, or until a specific pump outlet pressure is obtained. Further, the pump control logic and be programmed to vary the stroke speed, the stroke pressure, and other timing elements. Once the energized, hydraulic pump 980 transports hydraulic fluid through pump outlet 984 and valve 986 through passage 935 way in rest tandem sub 933. This exerts pressure on the face of piston 941 and forces piston 941 to travel down toward the distal end of the lower cylinder 940. The hydraulic fluid accumulates in a reservoir created in the lower cylinder 940 between the piston 941 and the lower face of reset tandem sub 933.

As described above, setting tool 900 can be reset by placing the setting tool on the resetting tool described above. The return fluid passageway is opened and the weight of setting tool 900 is used to force the hydraulic fluid to return to hydraulic reservoir 941 by forcing cross link 960 up to the lower cylinder 940. Once reset, the return fluid passageway is closed and the tool is reset for use.

Setting tool 900 can also be configured for horizontal applications by adding an attic cylinder as described above.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A non-explosive setting tool for use in setting an auxiliary tool comprising:

(a) an explosive setting tool comprising explosive elements, a pressure chamber, an upper cylinder, a lower cylinder, and a cylinder connector;

wherein the explosive setting tool has been configured to receive conversion elements by removal of a floating piston;

(b) the conversion elements comprising an insulated contact terminal, a gear motor, a hydraulic pump, and a face seal engaging mechanism, wherein the face seal en a in mechanism further comprises:

a spring housing;

the face seal; and a sliding tube having an outside diameter dimensioned to fit within the upper cylinder of the explosive setting tool, having an inside diameter configured to receive the gear motor and hydraulic pump, and further dimensioned to compress the spring housing and engage the face seal with the cylinder connector when the pressure chamber is fully engaged with the upper cylinder.

2. The non-explosive setting tool of claim 1, wherein the explosive setting tool is a Baker model E-4 explosive setting tool.

3. The non-explosive setting tool of claim 1, wherein the explosive setting tool is a size 10 Baker model E-4 explosive setting tool.

4. The non-explosive setting tool of claim 1, wherein the explosive setting tool is a size 20 Baker model E-4 explosive setting tool.

5. The non-explosive setting tool of claim 1, wherein the explosive setting tool is a Halliburton Shorty setting tool.

6. The non-explosive setting tool of claim 1, wherein the spring housing further comprises:

an upper spring housing;

a lower spring housing; and a discharge rod connected to the pump outlet and dimensioned to fit within the lower spring housing and form a seal with the lower spring housing when the face seal engaging mechanism is engaged.

7. The non-explosive setting tool of claim 1, wherein the face seal is a rubber 0-ring.

8. The non-explosive setting tool of claim 1, wherein a fluid return path is created within the face seal engaging mechanism when the face seal is disengaged by backing off the pressure chamber from the upper cylinder, the fluid return path allowing fluid to flow from the lower cylinder through the face seal engaging mechanism and into the upper cylinder and pressure chamber.

9. A method of retrofitting an explosive setting tool, the tool including a pressure chamber, an upper cylinder, a lower cylinder, a cylinder connector, and a floating piston, for use in setting an auxiliary tool, the method comprising the steps of:

removing the floating piston from the explosive setting tool;

installing conversion elements into the upper cylinder of the explosive setting tool, wherein the conversion elements further comprise a motor controller, a gear motor, a hydraulic pump, and a face seal engaging mechanism, and wherein the face seal engaging mechanism further comprises a spring housing, a face seal, and a sliding tube having an outside diameter dimensioned to fit within the upper cylinder of the explosive setting tool, having an inside diameter configured to receive the motor controller, gear motor, and hydraulic pump, and further dimensioned to compress the spring housing and engage the face seal with the cylinder connector when the pressure chamber is fully engaged with the upper cylinder;

installing an insulated contact terminal in the pressure chamber of the explosive setting tool; and connecting the conversion elements with the insulated contact terminal.

10. The method of claim 9, wherein the explosive setting tool is a Baker model E-4 explosive setting tool.

11. The method of claim 9, wherein the explosive setting tool is a size 10 Baker model E-4 explosive setting tool.

12. The method of claim 9, wherein the explosive setting tool is a size 20 Baker model E-4 explosive setting tool.

13. The method of claim 9, wherein the explosive setting tool is a Halliburton Shorty setting tool.

14. The method of claim 9, wherein the spring housing further comprises:

an upper spring housing;

a lower spring housing; and a discharge rod connected to the pump outlet and dimensioned to fit within the lower spring housing and form a seal with the lower spring housing when the face seal engaging mechanism is engaged.

* * * * *